US007946305B1

(12) United States Patent
Mailman

(10) Patent No.: US 7,946,305 B1
(45) Date of Patent: May 24, 2011

(54) BEACH UMBRELLA WEIGHT

(76) Inventor: Charles Mailman, Lexington, MA (US)

( * ) Notice: Subject to any disclaimer, the term of this patent is extended or adjusted under 35 U.S.C. 154(b) by 0 days.

(21) Appl. No.: 12/853,426

(22) Filed: Aug. 10, 2010

(51) Int. Cl.
*A45B 3/00* (2006.01)

(52) U.S. Cl. ..... 135/16; 135/120.1; 135/905

(58) Field of Classification Search ..... 135/118, 135/120.1, 905; 248/910; 383/16, 22, 75, 383/113; 220/475, 751
See application file for complete search history.

(56) References Cited

U.S. PATENT DOCUMENTS 2,616,467 A * 11/1952 Cicero ..... 383/16
4,154,255 A * 5/1979 Weaver ..... 135/16
4,924,893 A * 5/1990 Furey ..... 135/16
4,979,833 A * 12/1990 Cook ..... 383/12
5,169,111 A * 12/1992 Dunaj ..... 248/523
5,396,916 A * 3/1995 Boissonnault ..... 135/16
5,452,877 A * 9/1995 Riffle et al. ..... 248/511
5,520,364 A * 5/1996 Bloxson et al. ..... 248/500
5,737,883 A * 4/1998 Rose ..... 52/169.9
6,186,662 B1 * 2/2001 Jackson ..... 383/16
6,398,410 B1 * 6/2002 Guerra ..... 383/24
6,675,819 B2 * 1/2004 Arrowood et al. ..... 135/16
7,168,437 B2 * 1/2007 Bigford ..... 135/16
D625,508 S * 10/2010 Thurrott et al. ..... D3/10

* cited by examiner

*Primary Examiner* — David Dunn
*Assistant Examiner* — Noah Chandler Hawk
(74) *Attorney, Agent, or Firm* — Mark P White

(57) ABSTRACT

A method for stabilizing a beach umbrella includes the steps of configuring a one or more bags, each having a reclosable top opening, and having attachment cords at the upper and lower ends of each bag, filling the bags with a medium such as sand or water, and suspending the bags from the umbrella by affixing each either to the pole or above the junctures of the canopy struts and the pole, or at the junctures of the longer and shorter canopy struts.

11 Claims, 7 Drawing Sheets

BEACH UMBRELLA WEIGHT

This method describes a means to stabilize an umbrella, typically of the type known as a "beach umbrella", and of the type typically having a central shaft inserted into the sand at the beach. Such a beach umbrella is typically destabilized by the wind, which can cause it to shift to an unwanted position, or, in some cases, to be pulled out of the sand entirely, and be blown away, and/or interfere with other people or materials on the beach.

DESCRIPTION OF PREVIOUSLY AVAILABLE SYSTEMS

A traditional beach umbrella is shown in FIG. 7. This beach umbrella consists of a canopy 21 supported by struts 19. A pole 15 is affixed to the struts. In operation, the end of the pole is simply inserted into the sand 16. This type of beach umbrella is lightweight and easy to transport. But wind can easily dislodge this type of umbrella, irritating both the owner and nearby beachgoers.

Another traditional version of the beach umbrella is shown in FIG. 6. This version has a canopy and struts similar to the umbrella shown in FIG. 7, and further rests on a weighted base. Although this type of arrangement can be fairly stable, it is unwieldy and awkward to transport, and to carry onto the beach.

A number of other patents have issued to remedy this and similar situations. Typical of these is U.S. Pat. No. 7,520,485 (Giannetto) for a "Multi-Mode Beach Umbrella Anchor". This umbrella anchor has a spike at the end of the umbrella pole which is driven into the sand. Another design of this nature may be shown in U.S. Pat. No. 7,007,703 (Brooks, III) for an "Umbrella with an integral anchoring structure", as shown in FIG. 8 (prior art), wherein the umbrella pole has an auger-shaped assembly 28 integrally formed at the bottom, which can be screwed into the sand.

The present design provides for a stable beach umbrella which is lightweight and easy to transport and install, overcoming the shortcomings of the previously used versions.

SUMMARY OF THE METHOD

The method described herein has the function of stabilizing a beach umbrella, preventing the disruption of the umbrella by the wind.

In accordance with a first aspect of the invention the method first requires the configuring of a bag having a top opening which can be repeatedly opened and closed, the bag having an upper attachment cord.

In accordance with a second aspect of the invention the bag is filled with a medium, such as sand or water.

In accordance with a third aspect of the invention, the bag is suspended from the umbrella by tying the upper attachment cord to the umbrella pole, or to the outer spokes of the umbrella.

In accordance with a fourth aspect of the invention the bag further has a lower attachment cord which is tied to the umbrella pole.

In accordance with a fifth aspect of the invention the bag is waterproof.

In accordance with a sixth aspect of the invention the bag has a tab at its closed end, and also has reinforcement material at its open end, the lower attachment cord being attached to the tab at one end, and the upper attachment cord is slidingly affixed to the bag at its open end.

In accordance with a seventh aspect of the invention two or more bags are configured, wherein the bags each have a reclosable top opening, and a upper attachment cord affixed in proximity to the top opening.

In accordance with an eighth aspect of the invention, all of the bags are filled with a medium, and the bags then suspended from the umbrella by tying each of the upper attachment cords above the intersection of two umbrella struts.

In accordance with a ninth aspect of the invention the bags comprise an inner lining.

In accordance with a tenth aspect of the invention the linings are waterproof.

BRIEF DESCRIPTION OF DRAWINGS

These, and other aspects of the method may be understood by referring to the drawings contained herein, in which.

DESCRIPTION

Summary of Reference Numbers

Figure 1:
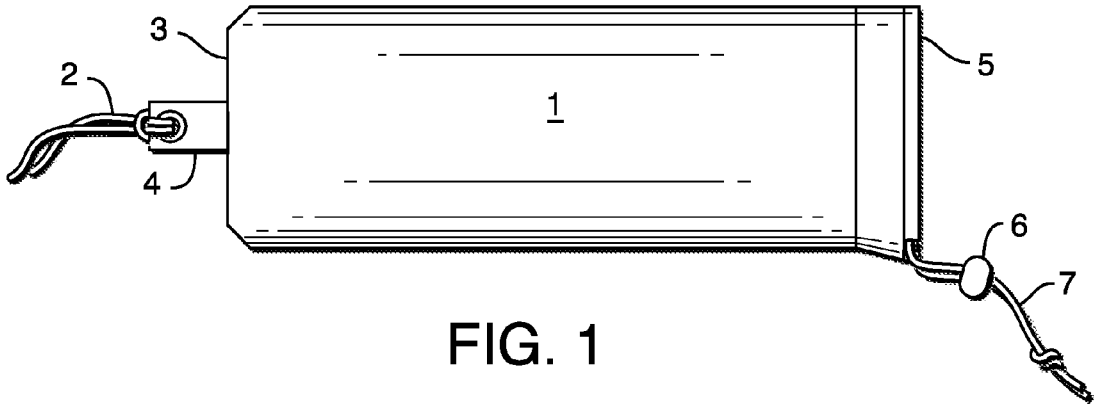
FIG. 1 depicts a bag in accordance with a first embodiment of the present method.

In the present application, the following reference numbers are used in connection with the elements of the drawings included herewith.

1. first side of a bag for use with the present method.
2. Lower attachment cord of bag
3. Closed end of the bag.
4. Tab at the closed end of the bag with eyelet to hold lower attachment cord.
5. Upper, open end of the bag
6. closure fitting for upper attachment cord.
7. Upper attachment cord of second embodiment of bag for use in present method.
11. lower attachment cord for use with second bag embodiment.
12. upper attachment cord for use with second bag embodiment.
13. Upper, open end of the second bag embodiment.
14. Lower, closed end of the second bag embodiment.
15. Umbrella pole
16. Sand into which umbrella pole is inserted
17. bags suspended from umbrella struts
18. upper attachment cord affixed to umbrella
19. umbrella struts
20. upper umbrella pole
21. umbrella canopy
22. side of first bag embodiment
23. second side of first bag embodiment
24. sleeve of umbrella base
25. umbrella base
26. reinforcement at upper, open end of bag
27. struts or spokes affixed to pole
28. Augur-shaped assembly

The Embodiments

Figure 7:
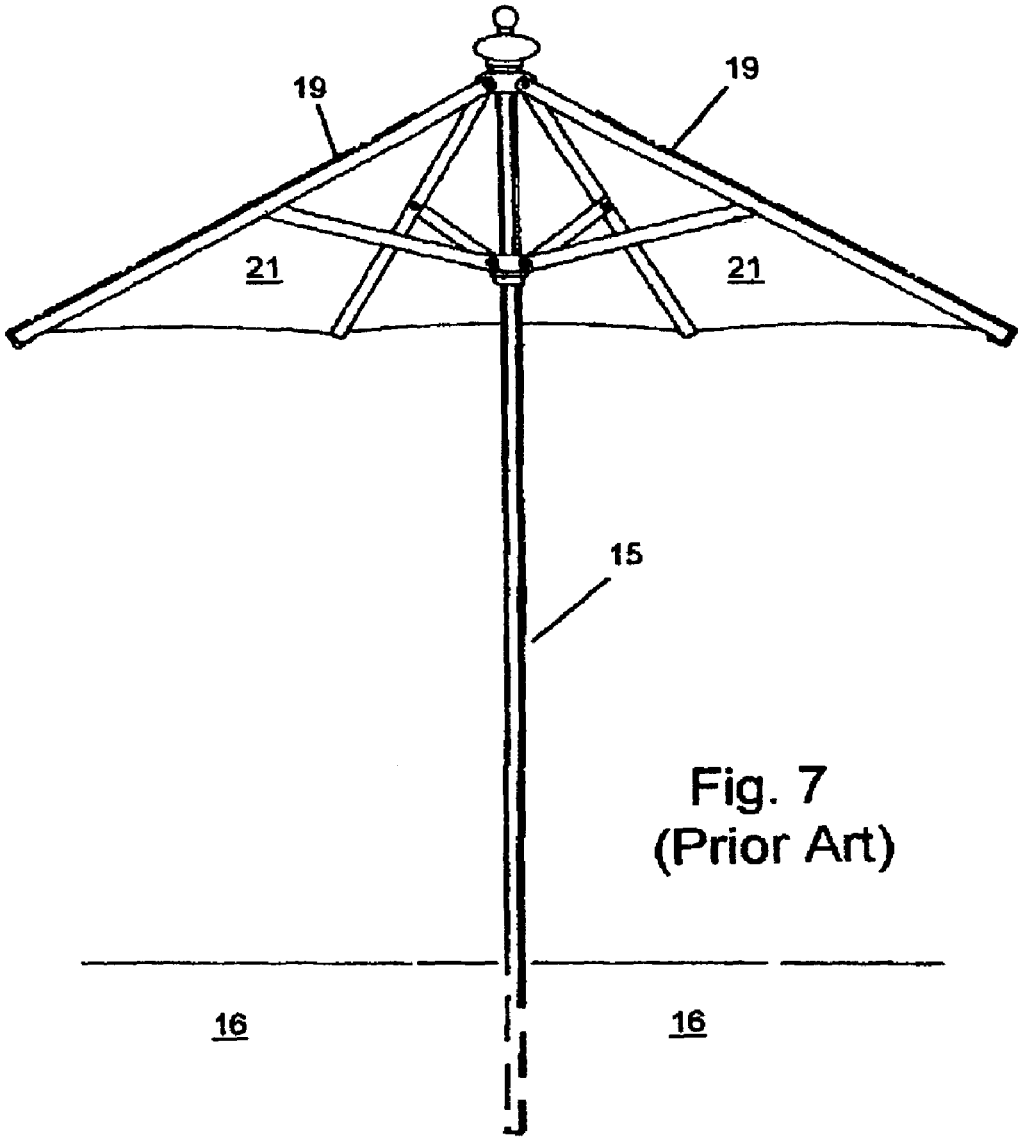
Fig. 7 (Prior Art)
FIG. 7 depicts a typical prior art beach umbrella with the pole inserted into the sand.
Figure 8:
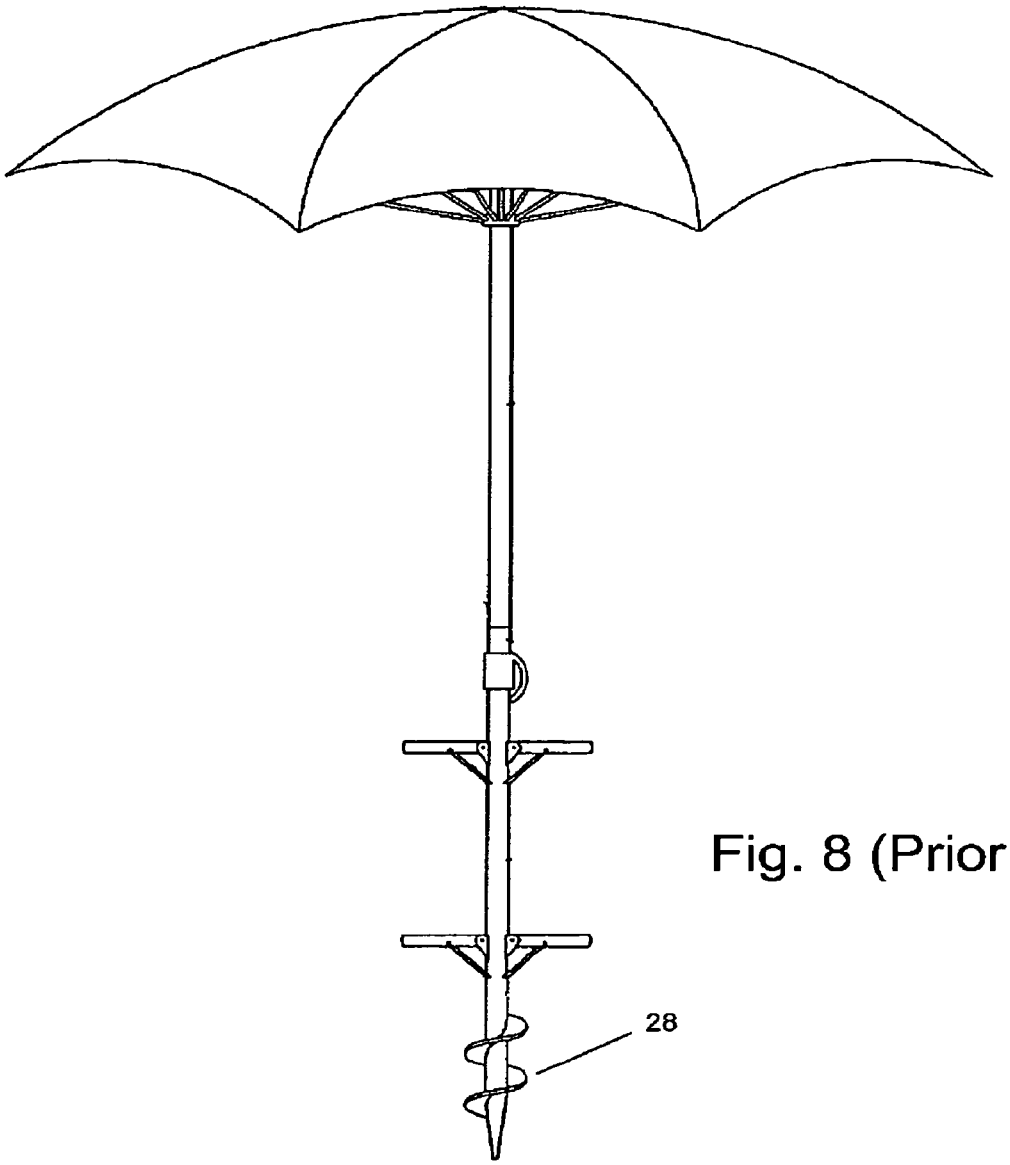
Fig. 8 (Prior Art)
FIG. 8 depicts a prior art beach umbrella with an augur at lower end of the pole.

The solution to the stability problems of previously used beach umbrellas is the use of an appropriately constructed bag which attaches to the existing beach umbrellas of the type shown in FIG. 7. The bag may be filled with water or sand, both available at the beach in copious quantities, and available on land as well. The bag or bags are first filled, and then affixed to the umbrella. Means are provided to seal the tops of the bags so that the contents will not be dislodged easily.

Figure 4:
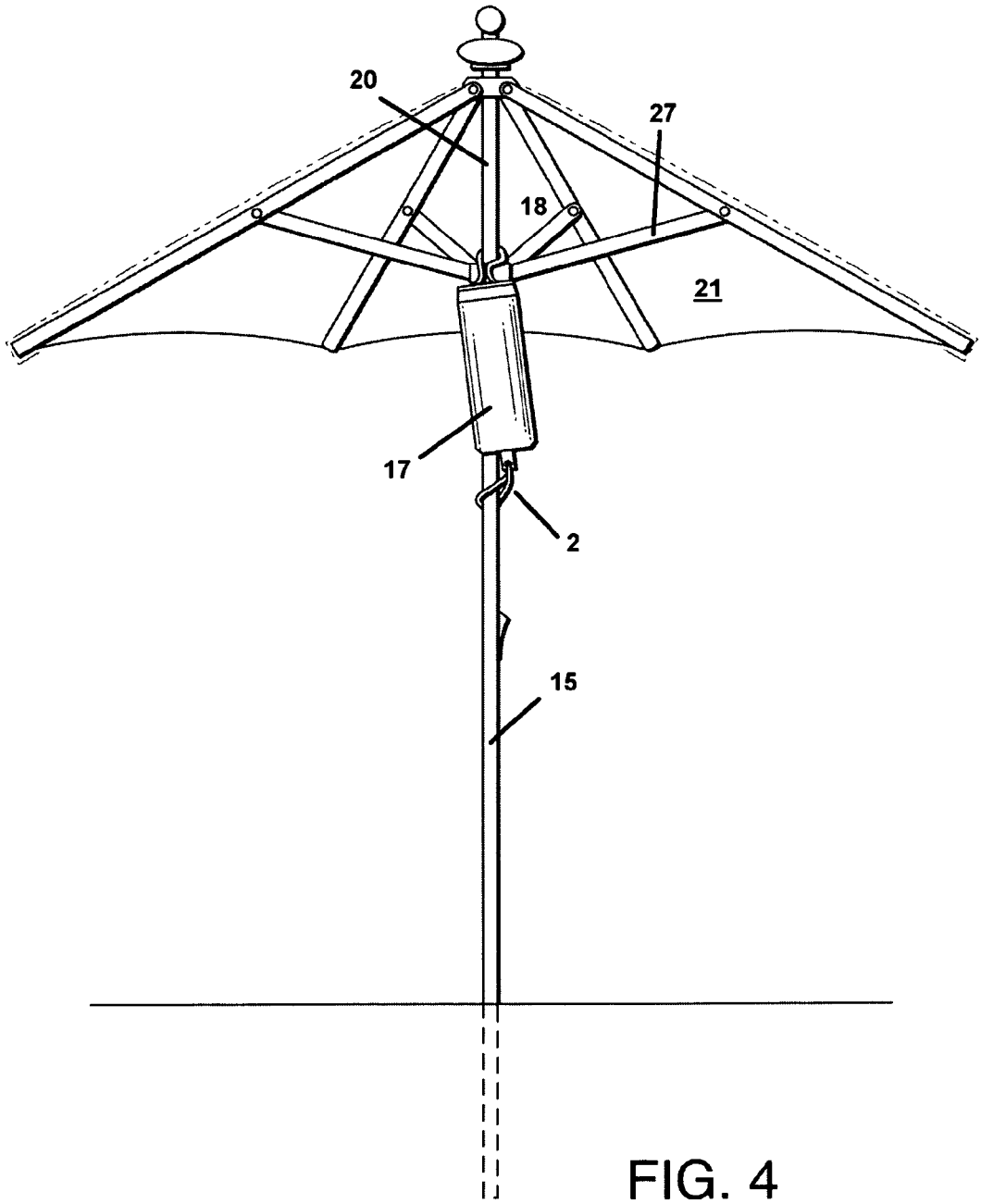
FIG. 4 depicts an umbrella stabilized by a single bag in accordance with a fourth embodiment of the present method.

A first embodiment of this design is shown in FIG. 4. The bag 17 is affixed to the umbrella by an upper attachment cord above the junction 18 of struts 27 and the pole 15. The bag is further affixed to the pole below the struts by means of the lower attachment cord 2. This application provides for sufficient weight to stabilize the umbrella in lighter winds. In heavier winds a second bag may be affixed to the pole in the same manner as just described.

Figure 3:
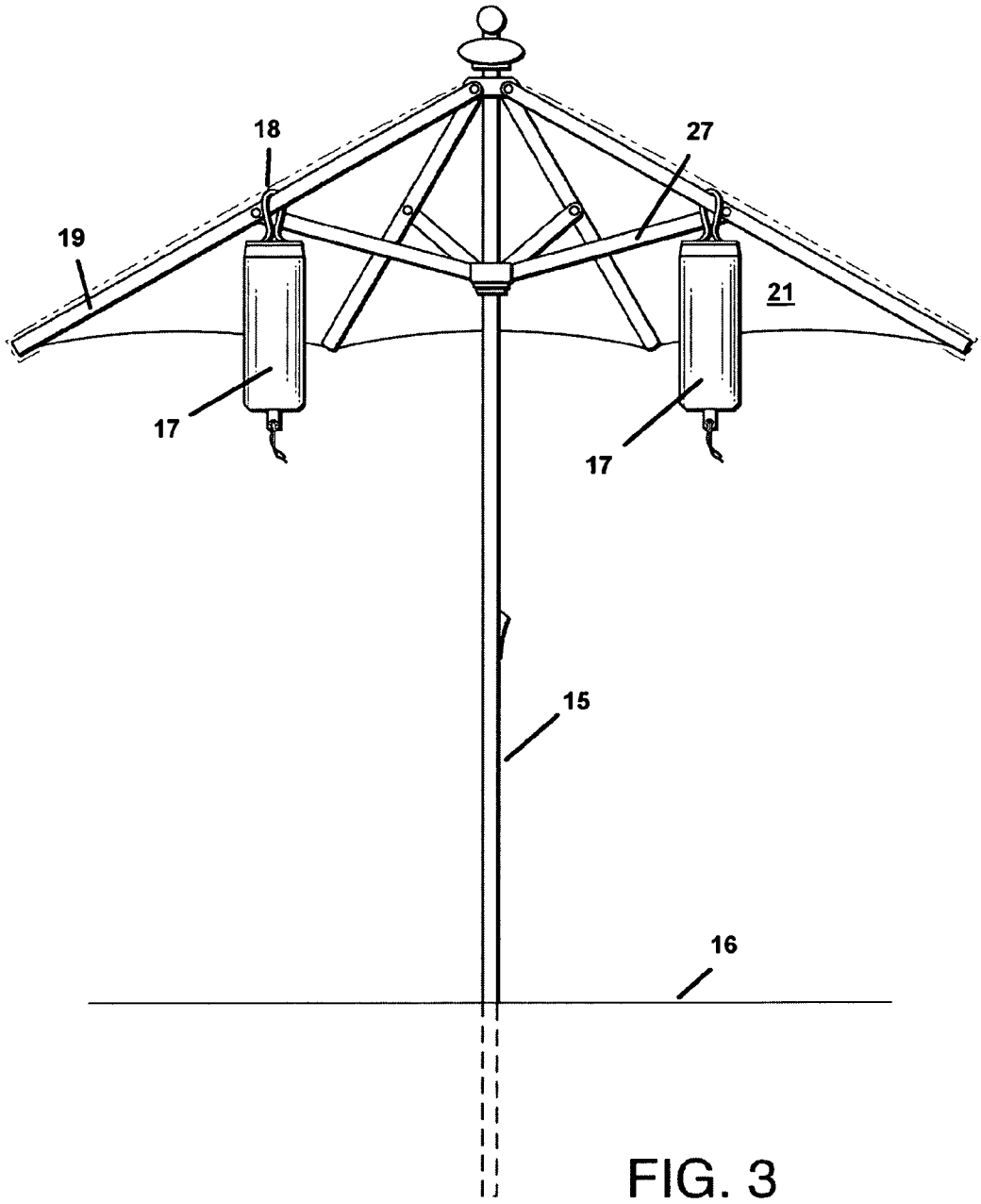
FIG. 3 depicts an umbrella stabilized by two bags in accordance with a third embodiment of the present method.

A second embodiment of this present design is shown in FIG. 3. In this embodiment the bags are affixed above the junction between the longer struts 19 and the shorter struts 27. Although two bags are shown in FIG. 3, bags can be suspended as shown at any of the other junctions above the intersections of the short and long struts as desired.

Figure 2:
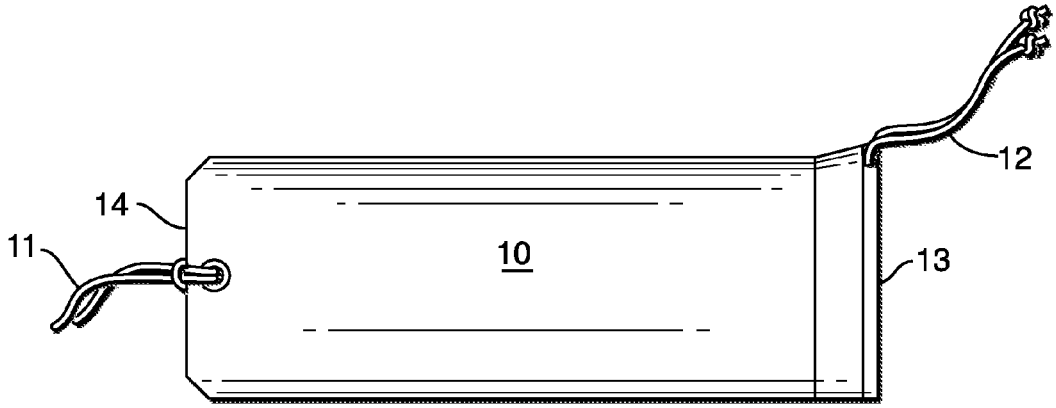
FIG. 2 depicts a bag in accordance with a second embodiment of the present method.
Figure 5:
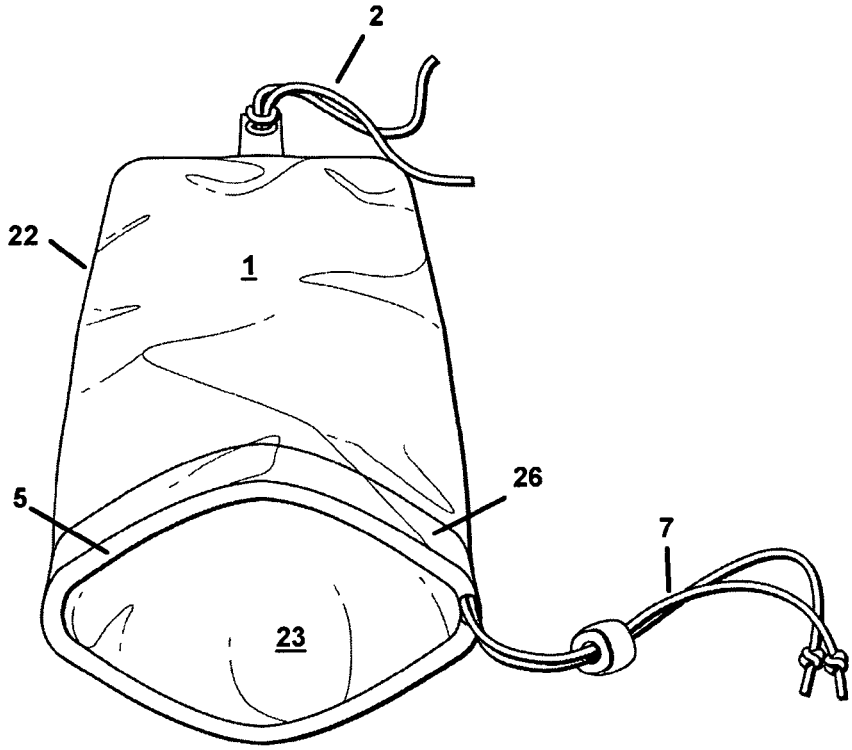
FIG. 5 Depicts a bag for use with the present method viewed from the mouth end, with the mouth open.
Figure 6:
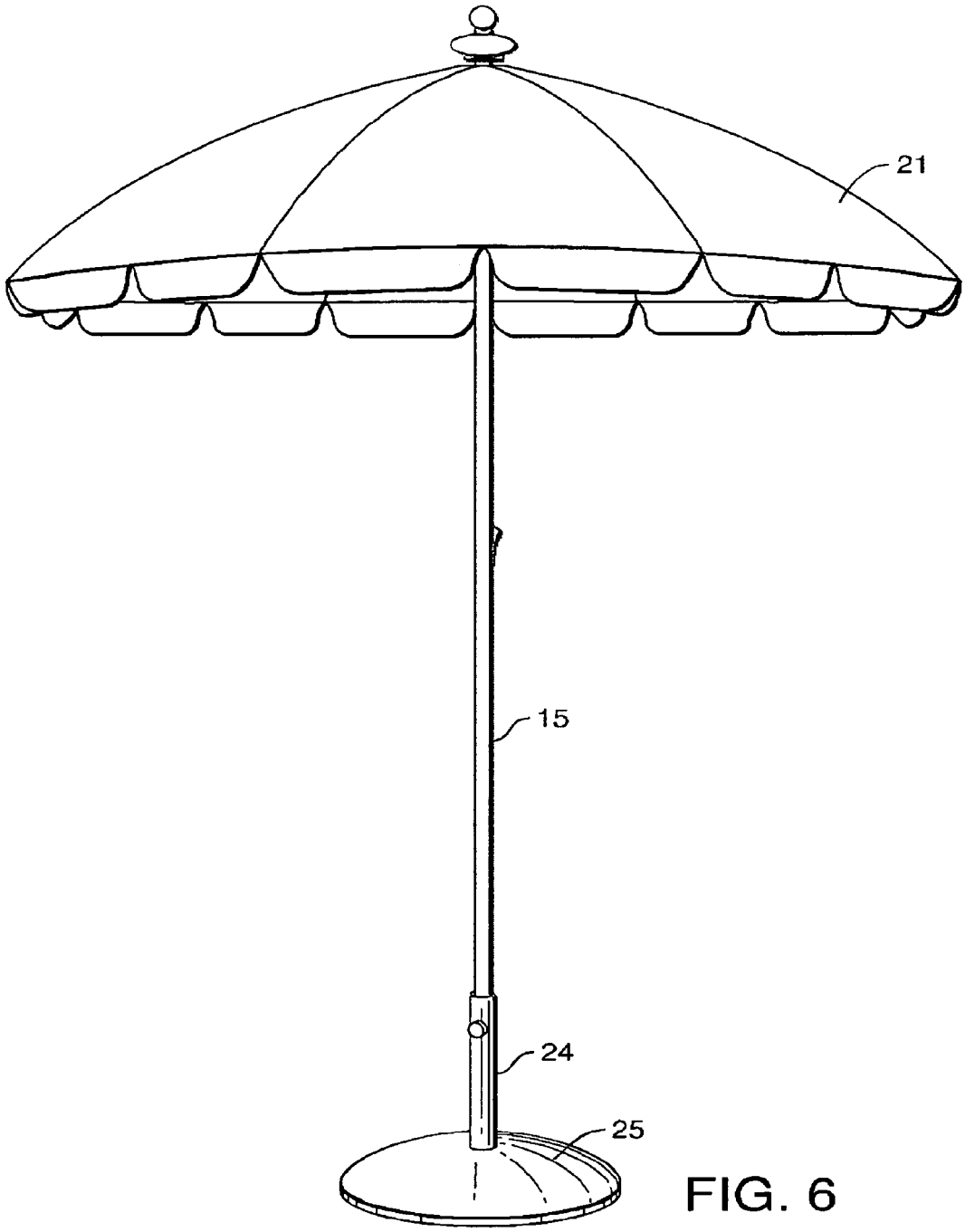
FIG. 6 ( PRIOR ART )
FIG. 6 Depicts a typical prior art beach umbrella standing on a base.

Typical embodiments of the bags themselves are shown in FIGS. 1 and 2. Referring now to the bag of FIG. 1, which is shown in perspective view in FIG. 5, the bag shown has a length L of 18 inches and a width of 6 inches. The body is formed from a first side 1 and a second side 23, wherein the two sides are affixed at the sides 22, typically by adhesive bonding or sewing. A reinforcement layer 26 is affixed to the open end 5 of the bag. The closed end 3 is similarly sealed by means which include adhesive bonding or sewing.

In the embodiment of FIG. 1 a lower attachment cord 2 is secured to the bag by means of an eyelet in a tab 4 which is securely bonded or sewn into the closed end 3 of the bag. When filled with sand to within an inch of the top, this bag weighed 5 pounds.

The alternative embodiment 2 provides for an eyelet directly affixed to the closed end 14 of the bag, wherein the closed end must be bonded or sealed off above the area of the eyelet, so that the material in the bag does not escape through the eyelet.

As further shown in FIGS. 1 and 2, the upper tie cord 7 or 12 is slidingly affixed as a draw string to the upper end of the bag 5, 13, above the reinforcement, to give the structure greater strength to counter the weight of the material within.

The embodiment of FIG. 1 further contains a closure fitting 6, well known in existing designs for crimping off such a draw string, which may be used to simplify the drawing up of the upper attachment cord to seal off the top end 5, 13 of the bag. This same upper attachment cord is also used to affix the bag to the umbrella itself.

An alternative embodiment uses mating hook-and-loop strips in proximity to the closed end of the bag, on either inside surface, to seal off the upper end of the bag after it has been filled with either sand or water.

The material of the bag may be any kind of robust fabric, or plastic. However, it should be a waterproof material if the bag is intended to be filled with water. An appropriate waterproof bag used in testing the method has a length of 19 inches and a width of 8¾ inches. This bag weighed about 10 pounds when filled near the top with water.

Tests have shown that the weight of the bag is not significantly different when filled with sand compared to water. The bags used weighed between 5 and 10 lb., when the dimensions varied between the limits described above, and when the bags were filled to within an inch or two from the top.

Although the embodiments describe the present method as being applicable to beach umbrellas, the method is clearly equally applicable to a wide variety of other umbrellas having a canopy supported by spokes or struts, and a central pole.

In fact, the present method may be used with other types of devices having a canopy and support struts or spokes on which the bags described herein can be easily attached. An example of such other devices includes awnings, such as those affixed to one side of a roof on a porch, extending over the porch on cantilever arms.

While certain embodiments and examples have been used to describe the present method, many variations are possible and are within the spirit and scope of the method. Such variations will be apparent to those skilled in the art upon inspection of the specification and claims herein. Other embodiments are within the following claims.

The invention claimed is:

1. A method for stabilizing an umbrella, the umbrella comprising an umbrella pole, the method comprising the steps of:

a. configuring one or more bags, each bag further comprising a reclosable top opening and a upper attachment cord;

b. filling each bag with a medium to increase its weight, and c. suspending each bag from the umbrella by tying the upper attachment cord directly to the umbrella pole at an upper portion thereof and distal from a ground surface, and without the pole passing through a body of any of the bags.

2. The method of claim 1, the bag further comprising a lower attachment cord, the method further comprising tying the lower attachment cord in proximity to the umbrella pole below the bag.

3. The method of claim 2, the medium further comprising sand.

4. The method of claim 2, the medium further comprising water.

5. The method of claim 4, wherein the bag is waterproof.

6. The method of claim 3 or 5, the bag further comprising a tab at a closed end, and reinforcement at an opening end, the method further comprising affixing the lower attachment cord to the tab at one end, and wherein the upper attachment cord to is slidingly affixed to a channel at the bag's upper end.

7. A method for stabilizing an umbrella, the umbrella comprising a plurality of struts, the method comprising the steps of:

(a) configuring one or more bags, the bags each further comprising a reclosable top opening, and an upper attachment cord;

(b) filling each bag with a medium to increase its weight, and (c) suspending each of the bags from the umbrella by tying each of the upper attachment cords to one or more of the struts.

8. The method of claim 7, the medium further comprising sand.

9. The method of claim 7, the medium further comprising water.

10. The method of claim 8 or 9, the bag further comprising reinforcement at an open end, the method further comprising affixing the upper attachment cord at the reinforcement at the upper end.

11. The method of claim 9, wherein the bag is waterproof.

* * * * *